US006715436B2

(12) United States Patent
Coates et al.

(10) Patent No.: US 6,715,436 B2
(45) Date of Patent: Apr. 6, 2004

(54) SEA-GOING VESSEL AND HULL FOR SEA-GOING VESSEL

(75) Inventors: John L. Coates, Croydon (GB); Richard Anzböck, Vienna (AT); Stewart K. Willis, Aboyne (GB); Gerhard Strasser, Vienna (AT)

(73) Assignee: Stolt Offshore Limited (GB)

( * ) Notice: Subject to any disclaimer, the term of this patent is extended or adjusted under 35 U.S.C. 154(b) by 0 days.

(21) Appl. No.: 10/367,358

(22) Filed: Feb. 14, 2003

(65) Prior Publication Data

US 2003/0145774 A1 Aug. 7, 2003

Related U.S. Application Data

(63) Continuation of application No. 09/787,978, filed as application No. PCT/GB99/03156 on May 30, 2001, now abandoned.

(30) Foreign Application Priority Data

Sep. 24, 1998 (GB) ..... 9820807

(51) Int. Cl.[7] ..... B63B 1/00
(52) U.S. Cl. ..... 114/56.1
(58) Field of Search ..... 114/27, 65 A, 114/57, 56.1, 61.27, 61.28, 61.29, 61.3, 61.31, 63.32, 63; 440/66, 69, 70

(56) References Cited

U.S. PATENT DOCUMENTS

| | | | |
|---|---|---|---|
| 2,729,182 A | 1/1956 | Tommasi | 114/57 |
| 3,438,350 A | 4/1969 | Gallin | 114/56 |
| 3,757,724 A | 9/1973 | Lunde | 114/27 |
| 3,828,708 A | 8/1974 | Gerwick, Jr. et al. | 114/65 |
| 3,934,531 A | 1/1976 | Allen | 114/63 |

(List continued on next page.)

FOREIGN PATENT DOCUMENTS

| | | |
|---|---|---|
| EP | 0 803 432 A2 | 10/1997 |
| EP | 0 790 178 B1 | 8/2001 |
| GB | 2 023 074 A | 12/1979 |
| GB | 2 278 230 A | 8/1994 |
| GB | 2 300 605 A | 11/1996 |
| NL | 7907448 | 4/1981 |
| WO | WO 94/06675 | 3/1994 |
| WO | WO 95/25237 | 9/1995 |
| WO | WO 97/42393 | 11/1997 |

OTHER PUBLICATIONS

"JAG DEV' First Pioneer Ship to Enter Service", *Shipping World and Shipbuilder,* Dec. 1968, 4 pages.

Extracts from the McGraw Hill Encyclopedia of Science and Technology, 1960, pp. 268–291.

"Orelia" Summary Particulars Article, publication date unknown, 8 pages.

*Primary Examiner*—Stephen Avila
(74) *Attorney, Agent, or Firm*—Sheridan Ross P.C.

(57) ABSTRACT

There is disclosed a hull for a sea-going vessel of displacement type having a flat bottomed midship section (100) of a constant cross-section which is substantially rectangular in cross section below the water line, and a converging bow portion (200) extending from said midship section, said bow portion having a curved transition (H) between the bottom (F) thereof and each hull side, the transition (C) between bottom and sides along the bilges in said midship section being relatively sharp, and in particular of radius less than 0.5 m, for example 0.025 m. The stern section (300) shape includes two propulsion arches each formed by an inclined, substantially part-cylindrical surface (S) extending from the flat bottom aft and upward to join the transom. The hull form provides a working vessel with extremely efficient roll-damping, yet sufficient transit speed for worldwide operation. The hull form can be constructed at relatively low cost, avoiding for the most part the need to form compound curves.

28 Claims, 11 Drawing Sheets

U.S. PATENT DOCUMENTS

| | | | | | |
|---|---|---|---|---|---|
| 3,938,457 | A | | 2/1976 | Dwyer | 114/56 |
| 4,046,092 | A | * | 9/1977 | Tornqvist | 114/61.31 |
| 4,182,253 | A | | 1/1980 | Bordes | 114/72 |
| 4,263,866 | A | * | 4/1981 | Shirley | 114/271 |
| 4,269,540 | A | | 5/1981 | Uyeda et al. | 405/168 |
| 4,345,855 | A | | 8/1982 | Uyeda et al. | 405/168 |
| 4,363,630 | A | * | 12/1982 | Di Vigano | 440/69 |
| 4,566,397 | A | | 1/1986 | Cavanaugh et al. | 114/56 |
| 5,317,982 | A | | 6/1994 | Jagers | 114/56 |
| 5,975,802 | A | | 11/1999 | Willis | 405/166 |

* cited by examiner

SEA-GOING VESSEL AND HULL FOR SEA-GOING VESSEL

CROSS REFERENCE TO RELATED APPLICATION

The present application is a continuation of U.S. patent application Ser. No. 09/787,978, filed May 30, 2001, now abandoned, entitled "SEA-GOING VESSEL AND HULL FOR SEA-GOING VESSEL", which is incorporated herein by this reference, which is a national phase application under 35 U.S.C. §371 of PCT Application No. PCT/GB99/03156 filed on Sep. 23, 1999.

The invention relates to sea-going vessels of the displacement (non-planing type) and in particular to the form of the hull for such vessels.

To date marine hulls have generally been designed on the principle that the hull is rounded to cause the minimum resistance to flow. This rounding has resulted in the classical clipper lines where the mid-body is faired into the bow and stern, with rounded bilges amidships (where the sides joint the bottom) and with compound curves at bow and stern.

In order to damp roll, bilge keels are added, and these carefully follow the flow lines, much effort being expended in tank towing trials to ensure that the keels do not exert avoidable drag.

On the other hand, some working vessels function mostly as stationary platforms, and are not designed for speed or efficiency in motion. Competing factors in the design are speed, efficiency, stability and cost. Other vessels, such as floating production, storage and off-loading (FPSO) vessels are designed to operate permanently at one location and may not even be designed to travel under their own power, but only with tug assistance.

Vessels required in the oil and gas production industry include drilling vessels, production vessels, well intervention vessels, accommodation vessels and the like. Such vessels typically have lengths (at the water line) in the range of 80 m–250 m (especially 100 m–200 m) and beam in the 15 m–30 m (especially 18 m–25 m). One known example used for various offshore support activities has a box shaped hull with ends shaped like a Thames lighter. The known vessel in fact bears a strong resemblance to a skip. The bilges are right angles and no bilge keels are fitted. This sharp edge or "chine" gives vastly improved roll damping. This, together with a highly sub-divided ballast system that allows optimum stability to be maintained for any load condition, gives the vessel a truly remarkable stillness in the water. The flat sides and bottom make it very cheap to build. Unfortunately, such a vessel is extremely slow (6 knots max.), making it unsuitable for use in a world-wide business.

In conventional design practice for sea-going vessels, it has generally been accepted that, no matter how much power is installed in a vessel of about 100–250 m with a rectangular cross section in the mid body, there is no possibility of pushing the vessel through the water at any speed above about 10 knots. The calculated power consumption is on the steep part of an exponential curve.

The present inventors had a desire to provide a new vessel having the stability and motion characteristics of the known vessel mentioned above, with a high transit speed. It would also be desirable to exploit the cheapness of construction afforded by avoiding as much as possible forming the hull of compound curves. Compound curves will be understood to refer to concave and convex surface portions having a substantial curvature in two dimensions, which require expensive pre-forming operations prior to assembly of the vessel. Those surface portions being part-conical, part cylindrical, or otherwise curved in one dimension only, together with twisted planar surfaces, will be referred to herein as portions having simple curves.

Of course, various forms of hull have been known for water-borne use, each form having evolved for a different type of use and/or environment. It was observed that in Rhine barge practice, the tug power is far below the theoretical requirements for such a hull, as indicated by conventional marine theory. In the case of Mississippi barges, the inventors found the same mismatch with conventional marine theory. Unfortunately, such barges would not survive long in the open sea.

The invention in a first aspect provides a hull for a sea-going vessel of displacement type having a flat bottomed midship section of a constant cross-section which is substantially rectangular in cross section below the water line, and a converging bow portion extending from said midship section, said bow portion having a curved transition between the bottom thereof and each hull side, the transition between bottom and sides along the bilges in said midship section being relatively sharp, and in particular of radius less than 0.5 m.

The bow shape may include a substantially vertical part-cylinder topped by a flared prow, for example, a part cone, with substantially simple curved and planar sheets leading back into the body, avoiding compound curves for the major part of the bow section. Compound curves may be employed judiciously to improve speed, but need only represent a few percent of the bow section surface area below the water line, less than thirty or twenty percent, for example.

The vertical part cylinder forming the stem of the vessel below the water line may be extremely fine, effectively resulting in a pointed bow. Alternatively, given a beam of say 20 m, the stem may have a radius at the water line up to 0.5, 0.75 or even 1 m about the vertical axis. The part cylinder may be replaced by a part cone, having a finer radius or even a sharp point at the forefoot (where the stem meets the ships's bottom), and a larger radius where it meets the more flared prow above the water line.

The same cylindrical portion may curve aftwards to join the bottom of the vessel, forming a minor forefoot portion of compound curve.

The flared prow above the water line affords a marked, steady increase in available buoyancy in waves beyond a certain size. The same principle may be applied to a stern that divides a following sea and flares to provide the required increase in buoyancy without slamming.

Alternatively, in accordance with a second aspect of the invention, there is provided a sea-going vessel with (at least below the water line) a substantially rectangular midship section, in which the stern shape includes at least one propulsion arch (preferably two) formed by an inclined, substantially part-cylindrical surface extending from the flat bottom aft and upward to join the transom.

In a preferred embodiment, suitable for a dynamic positioning (DP) vessel, there are a pair of inclined part-cylindrical propulsion arches, the hull the arches being flared together so as to facilitate transverse thrusting from a steerable propulsion unit mounted in each arch. The flaring may be formed by a pair of twisted flat surface portions.

In accordance with a third aspect of the invention, a sea-going vessel having a flat bottomed midship section has a stern section provided with propulsion arches formed such that water flowing to occupy the propulsion arch comes predominantly from beneath the bottom, rather than from the sides of the vessel as it moves through the water. This is believed to be an advantageous and novel feature in sea-going vessels, as opposed to barges. Such behaviour may be achieved by the reclining part-cylinder construction mentioned above. In profile, the arches and associated portions may provide a marked flare, so as to provide reserve buoyancy to counteract pitching and to "roll" waves approaching from the quarters of the vessel.

The transom may be flat. Inclined intermediate flat portions may be provided between the curved arch and the transom to reduce drag. A transition zone of compound curve shape may be provided between the arch portions and the flat bottom portion, again to reduce separation in the water flow and consequent drag.

A fourth aspect of the invention provides a sea-going vessel, the hull of the vessel below the water line comprising less than five percent compound curves in surface area.

A fifth aspect of the invention provides a sea-going vessel, the hull of the vessel below the water line comprising a parallel midship section and bow and stern sections, the bow section comprising less than thirty, optionally less than twenty or ten percent compound curves in surface area.

A sixth aspect of the invention provides a sea-going vessel, the hull of the vessel below the water line comprising a parallel midship section and bow and stern sections, the stern section comprising less than thirty, optionally less than twenty or ten percent compound curves in surface area In any of these aspects the vessel may be over 80 m in length at the water line and over 15 m beam. It may have a maximum speed in excess of 10 knots. The vessel may be equipped for sub-sea operations, by the provision of cranes, dredging, diving, pipe- or cable laying equipment, and/or by the provision of one or more vertical openings (moonpools) in the vessel bottom. The vessel may in particular be equipped with various thrusters and computer control for dynamic positioning (DP). The vessel may have a variable deck load capacity in excess of 800 tonnes.

The vessel may have a substantially rectangular midship cross section with bilges (chines) of radius less than 0.5 m or optionally less than 0.2 m or 0.1 m or 0.05 m. The bridge at the junction of flat sides and bottom may in particular be constructed entirely without curved plates and without a bilge keel. In a preferred embodiment, the side and bottom plates are welded together via a solid bar or pipe of small diameter. The bar may be of rectangular or round cross section. It may have a diameter less than five times the thickness of the side and bottom plates. Using a 50 mm bar, for example, the radius curvature at the bilge may for example be just 25 mm.

The invention further provides a hull, which may be fabricated according to any of the above aspects at one location, for subsequent fitting at another location.

BRIEF DESCRIPTION OF THE DRAWINGS

Embodiments of the invention are illustrated, by way of example only, in the accompanying drawings, in which.

DETAILED DESCRIPTION OF THE EMBODIMENTS

Figure 1:
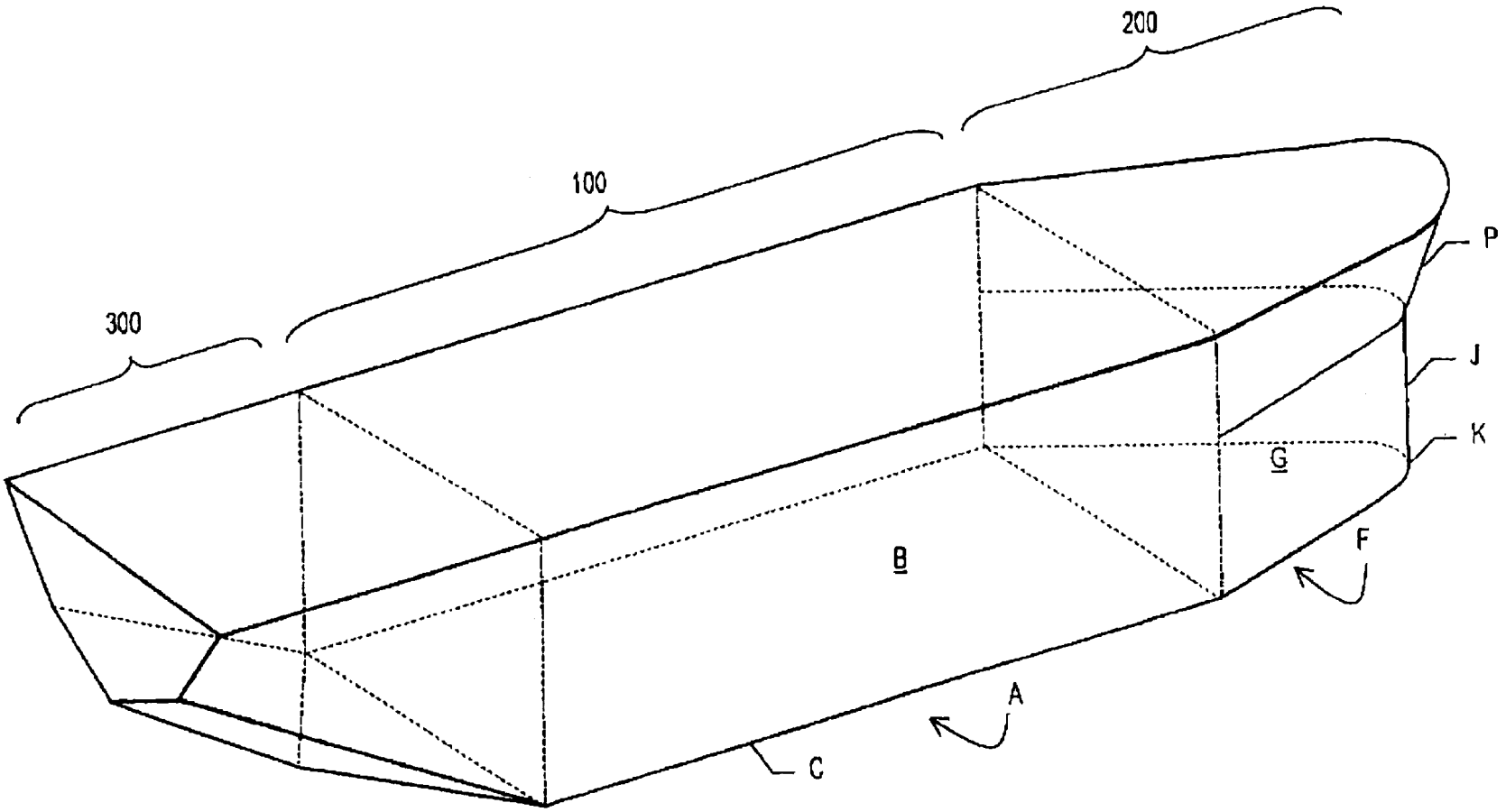
FIG. 1 is a sketch illustrating the principle of construction of a hull from planar and simple curved surfaces in a first embodiment of the invention.
Figure 2:
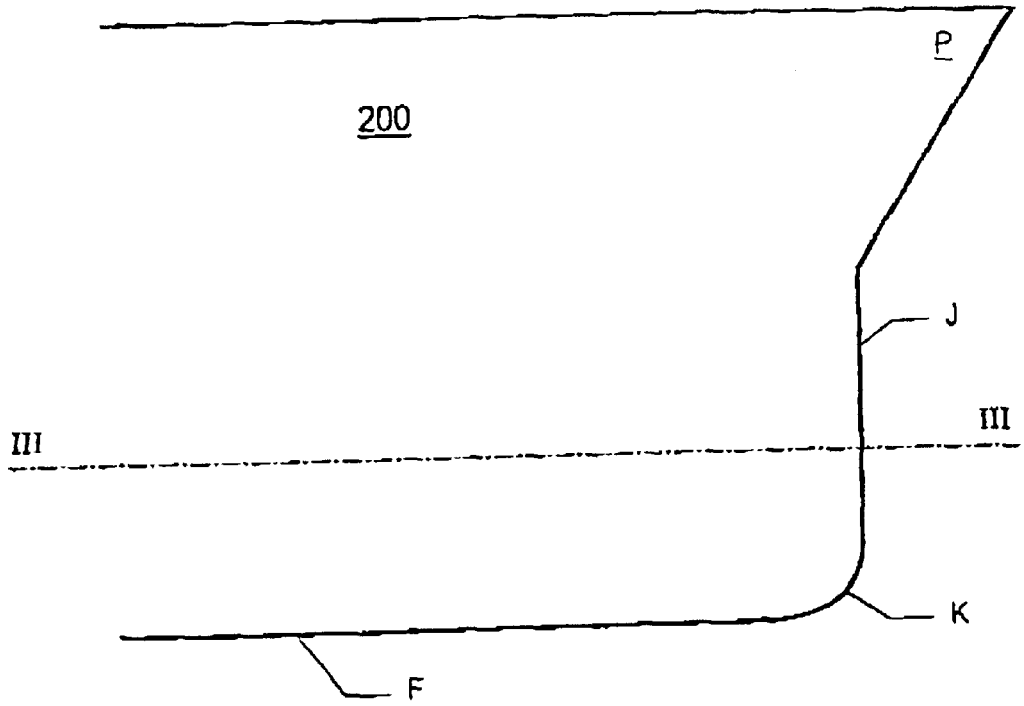
FIGS. 2 and 3 show bow section elevation and horizontal cross-section in a second embodiment of the invention, incorporating some compound curvature.

FIG. 1 illustrates the basic principle of the hull form in a simple embodiment. According to the initial proposal a sea-going vessel is proposed having a parallel middle body portion of strictly rectangular cross-section, with mid section 100, bow 200, and stern 300 formed entirely by flat and part-cylindrical plates, eliminating the need for "compound curves" to be pre-formed in the B and G steel plates. The vessel's sides in mid and bow sections respectively are essentially vertical, until above the water line, where a flaring at the bow provides extra buoyancy in high waves. The transom is highly flared to counteract stern waves in similar fashion.

Key to all of the embodiments is a sharp right angle chine or bilge C where the flat bottom A of the midship section 100 meets the vertical side B. As in the known vessel, mentioned above, this provides very strong roll damping, which provides a very still platform for work by divers, pipelay and other operations. The form of the bow and stern is more refined than in the known vessel, however, and trials show that suitable bow and stern forms can be designed to achieve useful transit speeds, notwithstanding the drag that would normally be associated with the hard chines. The flat of bottom F in the bow section 200 extends right to the forefoot K.

The crude design of FIG. 1 avoids completely the use of compound curvature. Significant performance improvements can be obtained at modest cost, by refining the design.

As will be described, the design may be refined as shown in FIGS. 2 to 6 and 7 to 15. In particular, simple curved (reclining part-cylindrical) sections have been introduced at the bow, below the water line, so that the sides are no longer entirely vertical over the bow portion. A small area of compound curvature is provided at the bow, to interface between the other portions, and to improve performance in the water. Transitional portions of compound curvature are also provided at the stern. Nevertheless, the combination of the rectangular cross-section for the parallel middle portion, and the use of strictly flat (planar) and simple curved part-cylindrical plates for the construction achieves great cost savings while allowing reasonable speed (>10 knots).

In the particular embodiments of the invention illustrated in FIGS. 2 to 15 of the accompanying drawings the hull of a sea-going vessel has the following notable features, which are labelled in common in the various embodiments:

Midship Section 100:

A constant, substantially rectangular cross-section below the water line is formed by planar bottom A and side portions B, the radius of curvature along the bilges C where the bottom and sides join being less than 0.5 m, 0.2 m or even 0.1 m or 0.05 m to provide effective roll damping.

An outward step or bevel D is formed above the water line, for example between 0.5 and 2 m on each side, to repel water and allow lower access ports.

Bow Section 200:

A flat bow bottom portion F extends as a tapering continuation of the midship bottom portion at least one third, a half or even two thirds of the way from the boundary with the midships portion toward the stem J. The taper may be linear or convex, but in the preferred design is concave.

A stem J comprising a vertical semi-cylindrical portion (FIG. 1, FIGS. 2 and 3) of relatively small radius about the vertical axis, for example less than 1 m, 0.75 m or 0.5 m (in the limit, a knife-edge). Alternatively (FIGS. 5; 7 to 15), the stem J may comprise a cone beginning with a small radius beneath the water line and expanding to a larger radius where the stem leaves the water and joins the flared prow P.

A rounded forefoot K comprising a continuation of the stem curving with a moderate radius (for example 1 m to 3 m) to meet the bow bottom portion F.

Above the stem substantially part-conical and steeply flaring prow portion P to provide increased buoyancy in heavy seas.

On each side a planar or twisted planar first bow side portion G extending as an upwardly tapering continuation of the respective midships side portion at least one third, a half or even two thirds of the way from the boundary with the midships portions toward the stem, and generally converging along a curve (by bending) toward the vessel centre line.

On each side optionally a simple curved second bow side portion N continuing from the forward edge of the first bow side portion, tapering upwardly and converging increasingly toward the vessel centre line. Portion N may be for example a part-conical surface having an (imaginary) apex below and in front of the bow, and an axis inclined upwardly and rearwardly. Alternatively (FIGS. 7 to 15) portion G may extend fully to the stem J.

On each side a simple curved portion H extending and increasing in height in the forward direction, interfacing between the upwardly tapering first bow side portion and the inwardly tapering bow bottom portion. Portion H may be for example a part-cylindrical or part-conical surface with an axis inclined upwards from the horizontal.

On each side of the stem a planar stem side portion L substantially parallel to the vessel centre line, the stem, rounded forefoot and stem side portions together forming a blade-like protuberance beneath the water line.

Figure 3:
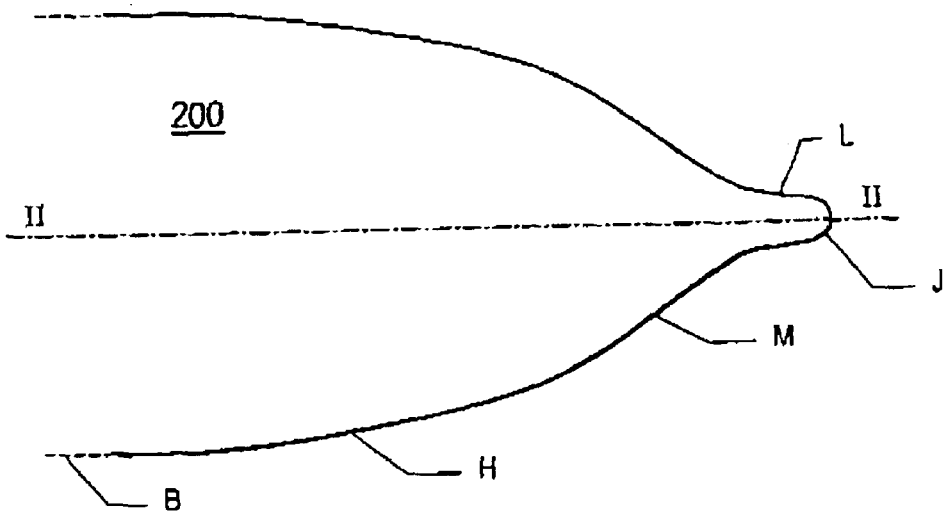
Figure 4:
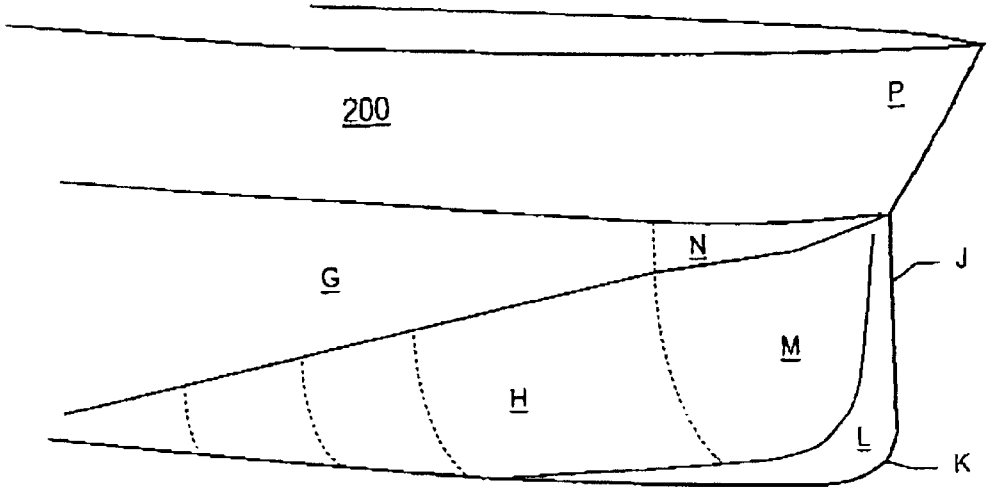
FIGS. 4 and 5 are side view and lower perspective view respectively of the bow section of FIGS. 2 and 3 in variations of the second embodiment.
Figure 5:
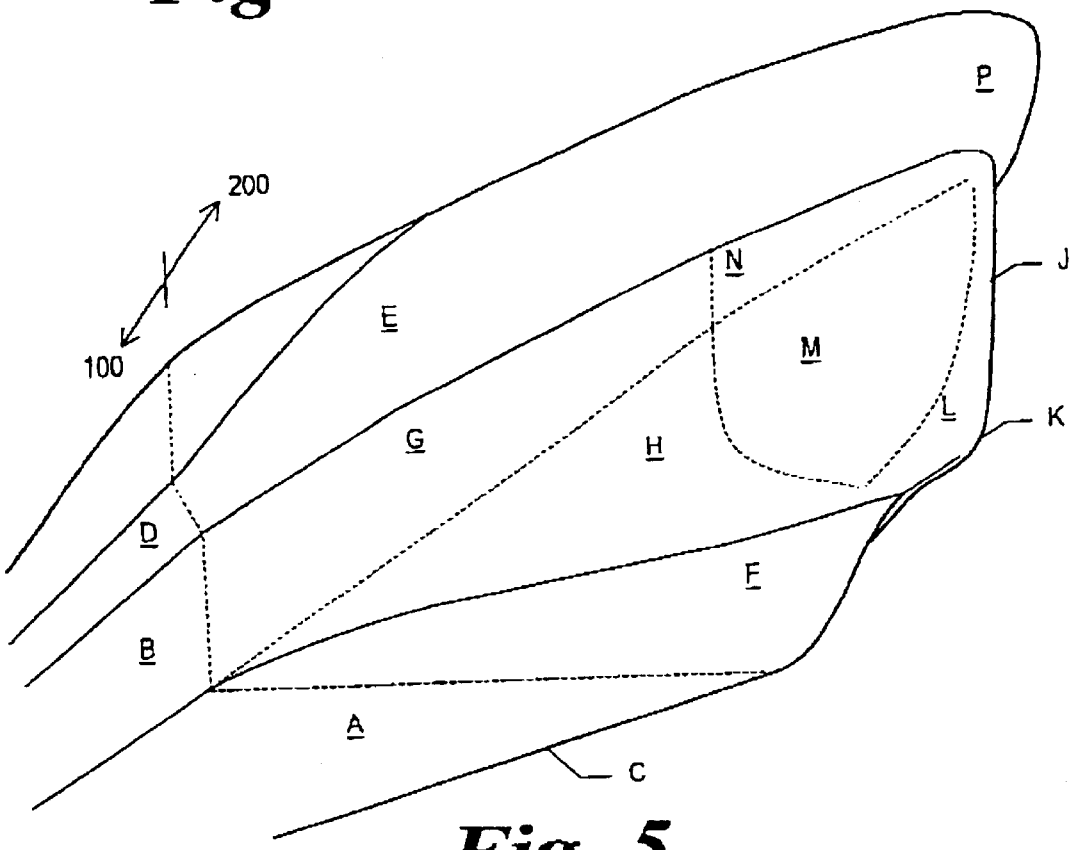
Figure 6:
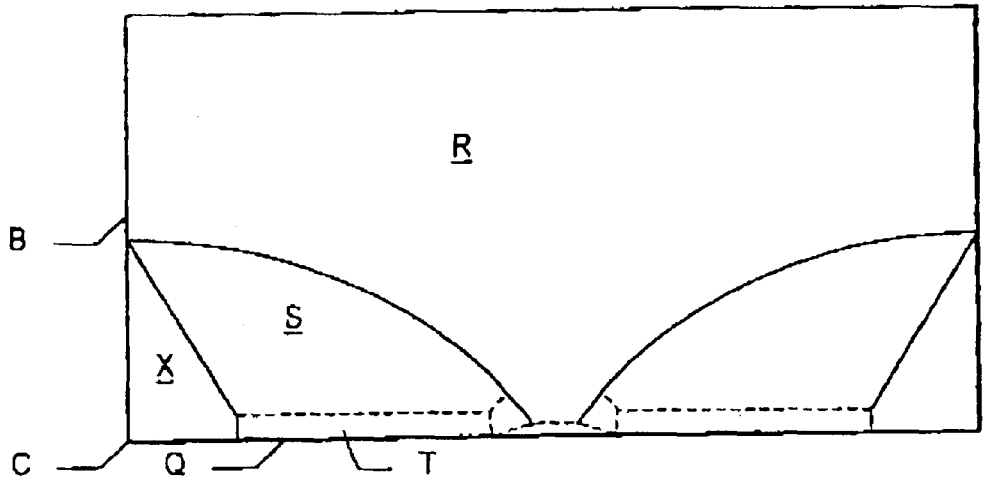
FIG. 6 is a view on the transom (rear) of the hull in the second embodiment.

On each side a convex compound curved portion M interfacing between the simple curved portion H and the stem or stem side portion L. This curved portion may be strongly convex like a Rhine barge or may be more gently faired. Its shape may be, for example, spheroidal, ellipsoidal, paraboloid. It may meet the stem side portions at an abrupt angle (as shown in FIG. 3), or taper gradually to the stem itself (FIGS. 7 to 15). It may comprise in area less than one third, for example between 2% or 5% and 10% or 15% of the bow section elevation.

Stem Section 300:

A flat stem bottom portion Q extending aft as a continuation of the midship bottom portion A from the boundary with the mid section 100.

A substantially planar transom R, which may be vertical or inclined to reduce "slamming".

On each side below the water line a simple curved concave propulsion arch formed for example by a substantially part-cylindrical surface S having an axis inclined upwardly extending from the flat bottom Q aftward and upward to join the transom R.

Inclined intermediate convex cylindrical and/or twisted planar portions X and Y interfacing between the curved arch S and transom sides, again to reduce drag, and to provide substantial flare.

In a dynamic positioning (DP) vessel, where thrusters located beneath the arch portions may need to thrust transversely of the centre liter, twisted flat portions U (FIG. 11) or other forms linking the port and starboard arches to reduce the obstruction to such sideways thrust.

Figure 11:
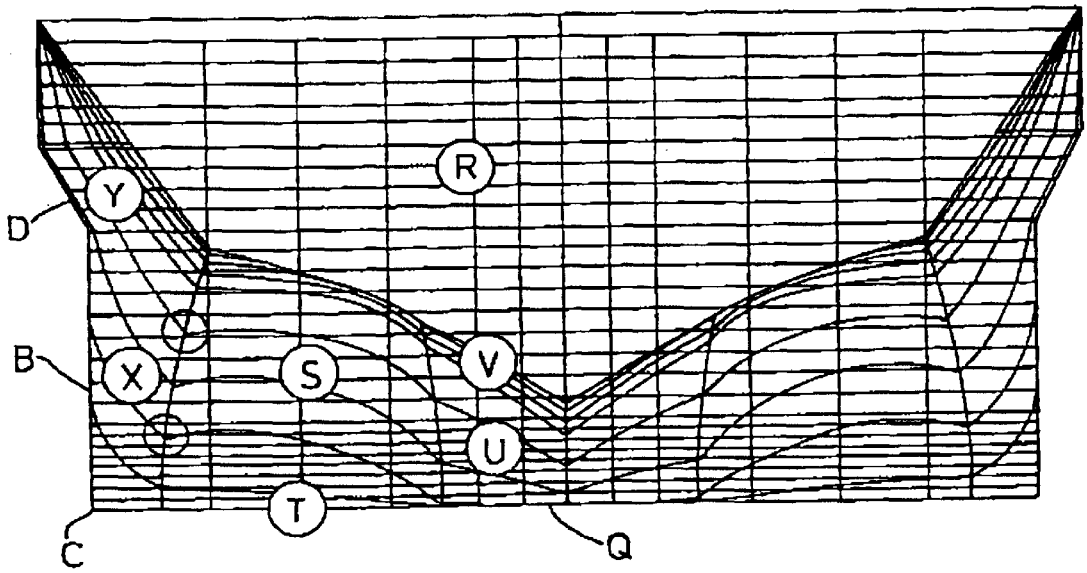
Figure 12:
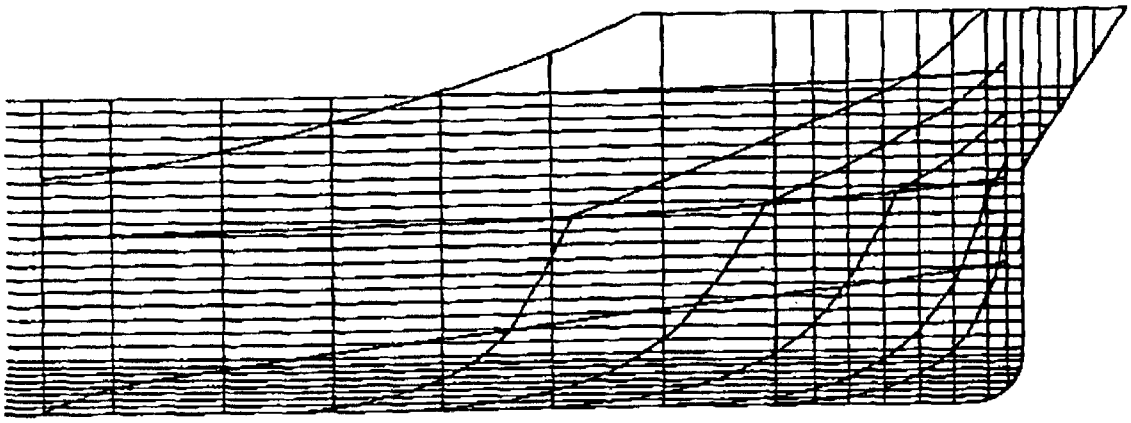
FIGS. 12 and 13 show respectively the bow and stern lines of the hull in profile.
Figure 13:
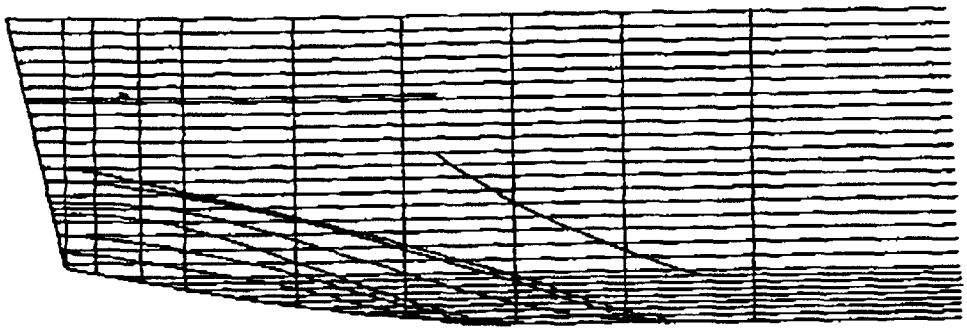
Figure 14:
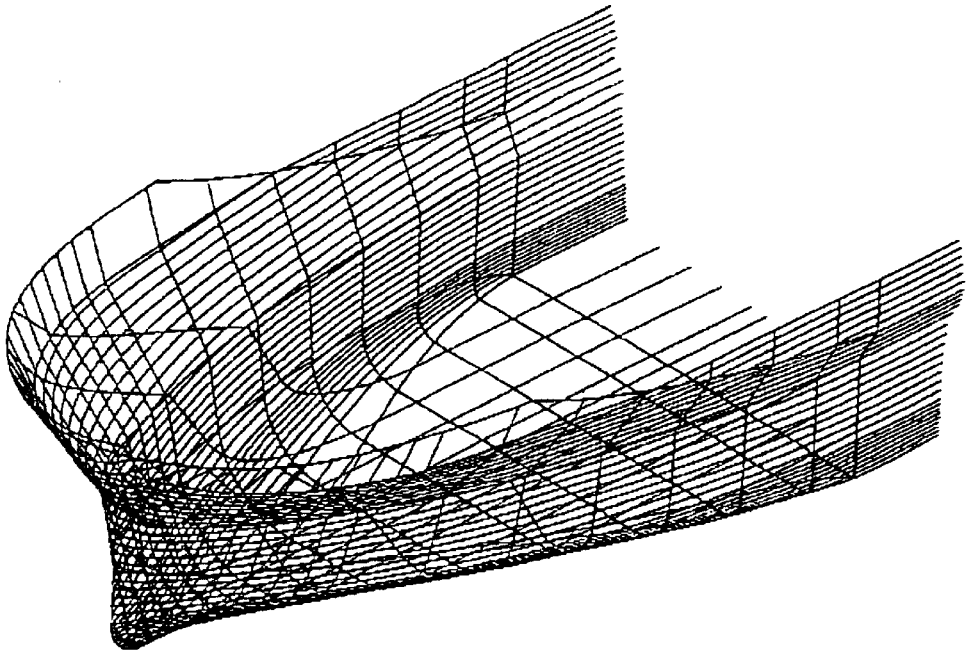
FIGS. 14 and 15 show respectively the bow and stern lines in oblique view.
Figure 15:
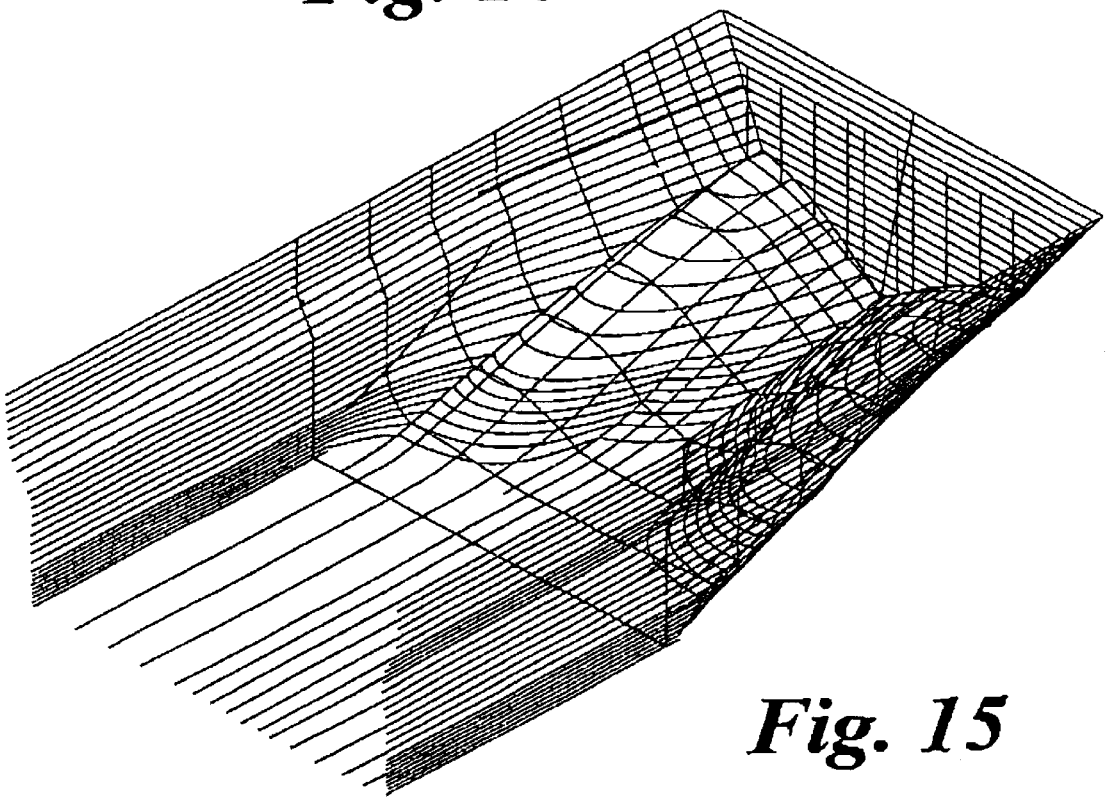

Transition zones T, V of compound curve shape may be provided between the arch portions, (T) and (V) and the flat bottom portion the transom R, to reduce separation in the water flow and consequent drag. In FIG. 11 certain angles are circled between portions Y, X and S, which could be smoothed if desired by the provision of further transition zones.

The details of construction can be varied, such that no one of the above features, and not the exact form of them, can be regarded as essential to the overall success of the hull form. The exact form of the hull will in general be perfected by trial and error in tank models, and/or by computer simulation.

Certain of the above features stand as inventions in their own right, including: the bow portion generally; the bulbous compound curbed portions and the stem blade; the stern portion generally and the specific features of the stem identified above. Conversely, the bow design presented herein can be used in the same hull as a more conventional stem section, and vice versa.

With a combination of planar and simple curved portions, together with very limited compound curves at the front portion of the bow and at the boundaries of the portions generally, a sea-going working vessel of over 100 m length having excellent stability and speed in excess of 10 or even 15 knots can be built for a cost significantly below that of any comparable vessel.

Figure 7:
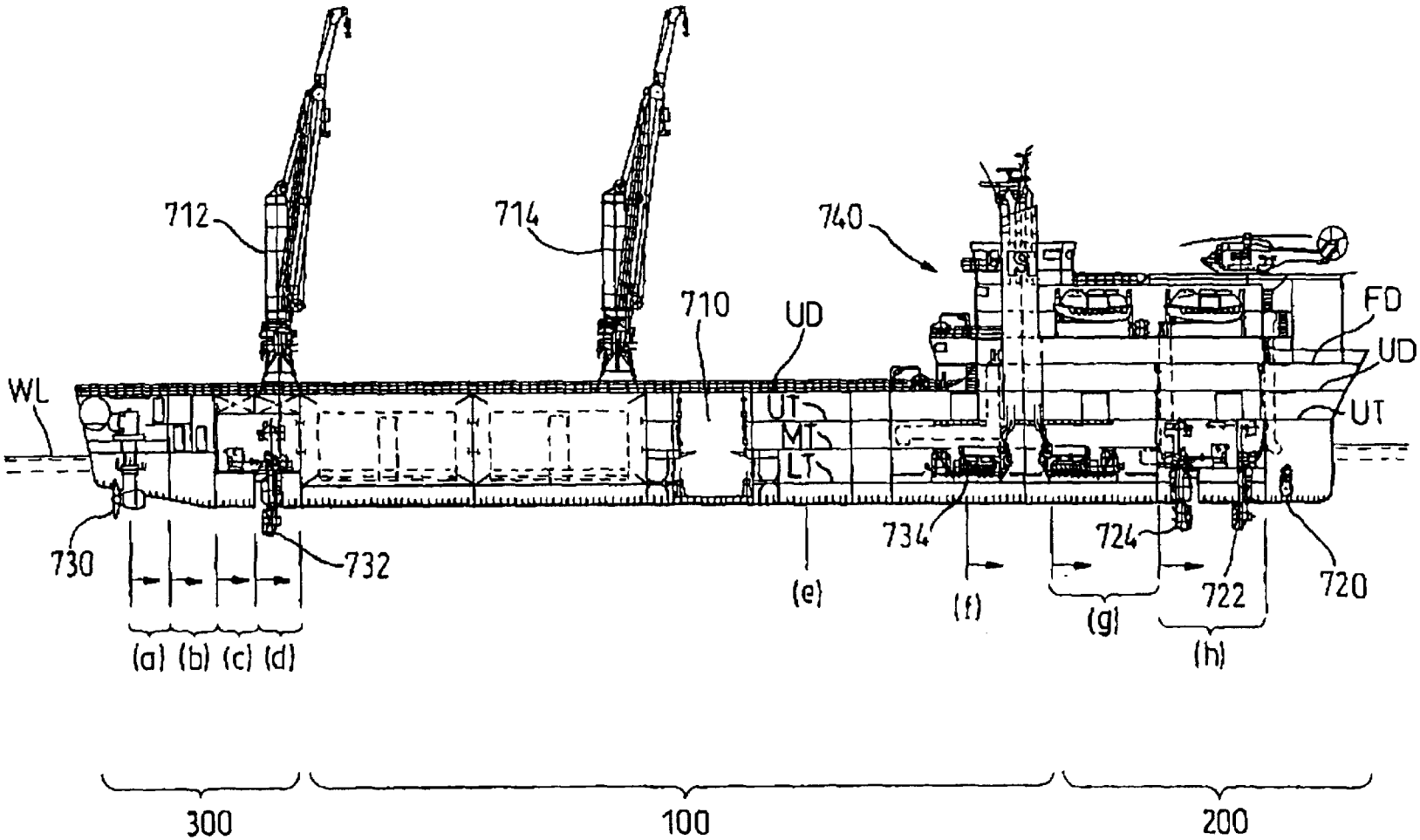
FIG. 7 shows the general arrangement of a working vessel having a similar hill form.
Figure 8A:
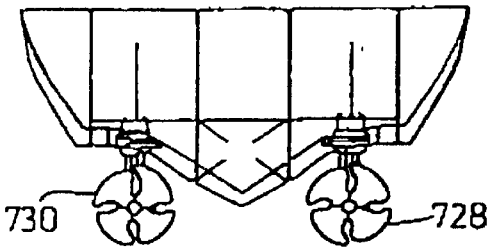
FIGS. 8(*a*) to (*h*) comprise sectional views of the vessel of FIG. 7 looking forward at various points along the length, indicated by corresponding letter (*a*) to (*h*) in FIG. 7.
Figure 8B:
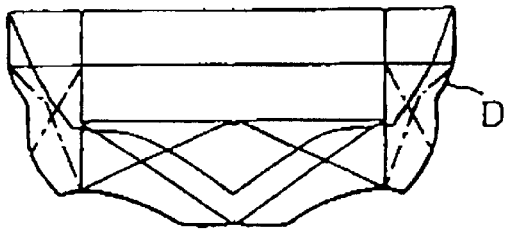
Figure 8C:
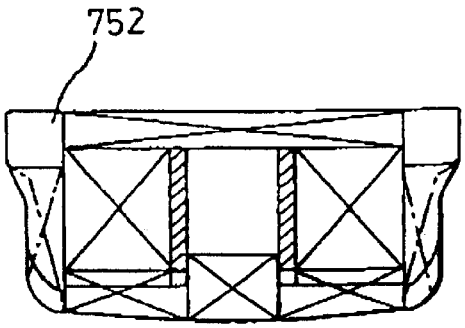
Figure 8D:
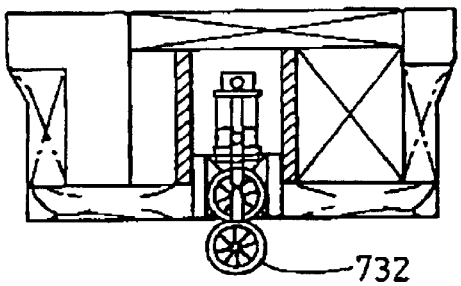
Figure 8E:
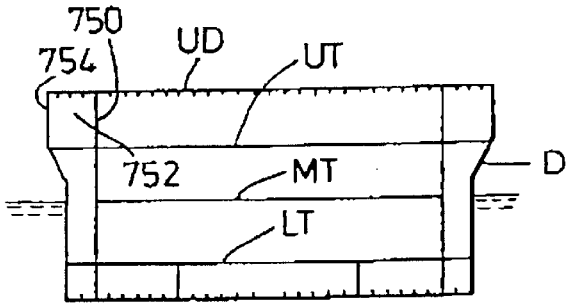
Figure 8F:
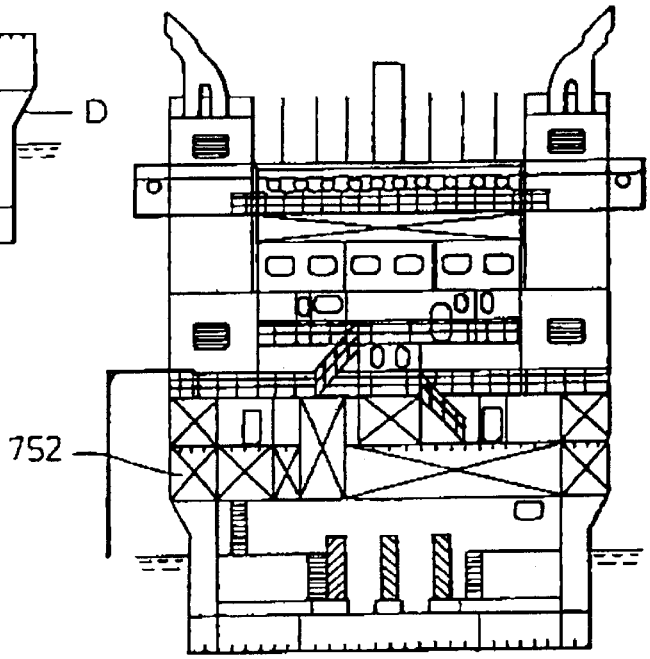
Figure 8G:
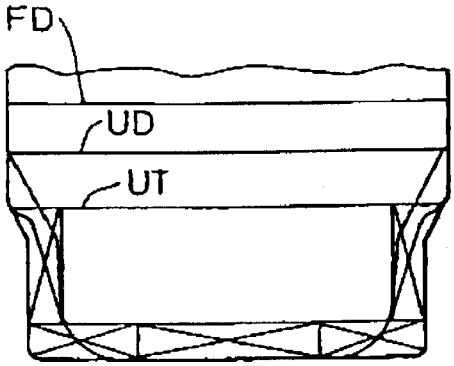
Figure 8H:
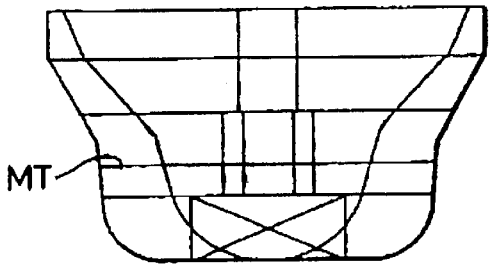
Figure 9A:
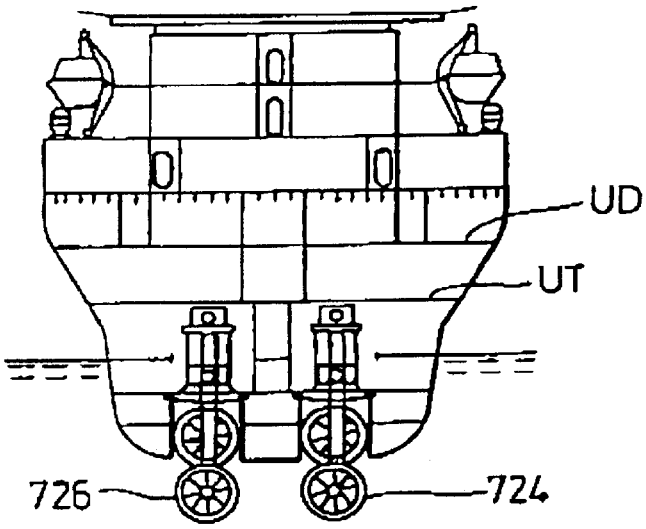
FIGS. 9(*a*) to (*c*) comprise further sectional views of the bow of the vessel, at the locations defined by various thrusters in FIG. 7.
Figure 9B:
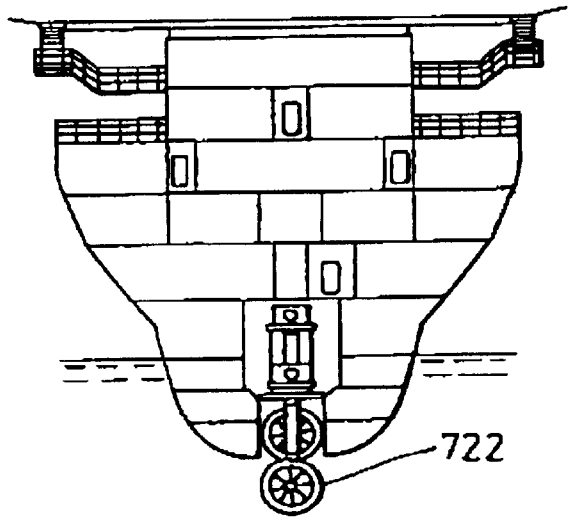
Figure 9C:
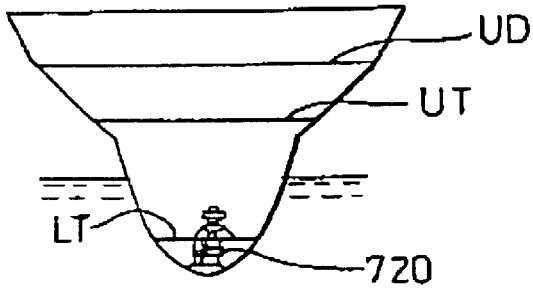
Figure 10:
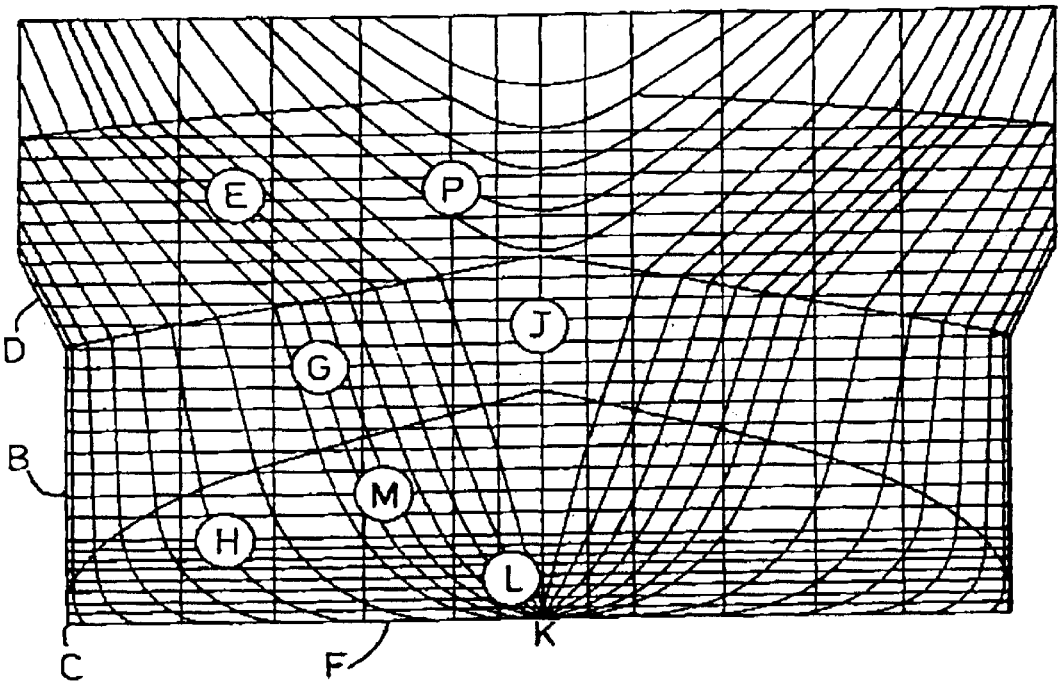
FIGS. 10 and 11 show the sectional lines respectively of the bow and stern of the hull form in the vessel of FIGS. 7 to 9.

FIGS. 7 to 9 show the general arrangement of a working ship which benefits from the novel hull form. The hull form itself is shown in more detail in the lines of FIGS. 10 to 15. FIGS. 8(*a*) to (*h*) show progressive sections through the stern section 300 of the ship, also the mid section 100 and the bow 300. Each Figure (except (*e*) and (*f*)) in fact includes two sections. The locations at these sections along the vessel are indicated by the corresponding letters (*a*) to (*h*) in FIG. 7.

The vessel is provided with a moonpool 710 for supporting subsea operations and working equipment such as two cranes 712, 714. The vessel is provided with seven thrusters 720–732. At the bow, thruster 720 is located in a transverse tunnel, while a forward centre thruster 722 and port and starboard thrusters 724 and 726 are retractable and steerable. At the rear, the port and starboard thrusters 728 and 730 are situated beneath the concave part-cylindrical propulsion arches (S in FIG. 11), while a retractable, central thruster 732 is located within the flat bottom portion of the stern section 300.

FIG. 9 shows additional sections through the bow at the locations of thrusters 720, 722 and 724, 726. All of these thrusters can be employed in dynamic positioning (DP) operations, under computer and satellite navigation control. Thrusters 728 and 730 remain deployed to provide propulsion for the vessel in transit between operating locations. As is well known, these thrusters are powered electrically from diesel electric power units 734 within the body of the vessel. Although physically larger than the retractable thrusters, the propulsion thrusters 728 and 730 need not be so powerful, for example, on the vessel of approximately 140 m by 21 m at the water line, each may have 5 MW power rating.

Various deck levels are identified as the lower tween deck (LT), mid tween deck (MT), upper tween deck (UT). The mid tween deck level corresponds approximately to the water line WL and upper deck (UD). At the forward end of the vessel, the flared bow section above the water line extends above the level of the upper deck and the focsle deck (FD) to provide optimum resistance to pitching and shipping water. This taller fore section of the vessel includes a super structure 740 with funnels, heli-deck, bridge and accommodation.

Along the sides of the vessel the inclinded portions (D in FIGS. 10 and 11) reflects waves approaching from the beam and keeps the deck substantially dry. Exploiting this wider portion, between the upper tween deck (UT) and (UD) level the main bulk heads extend only to inner side walls 750 (FIG. 8 (*e*)), leaving a clear space 752 between the inner side walls 750 and the outer side walls 754, for the provision of access and services (pipes, ducts and cabling) substantially the entire length of the mid section. This provision substantially eliminates the need to provide penetrations in successive bulkheads for the provision of such services, saving substantial cost.

Figure 16:
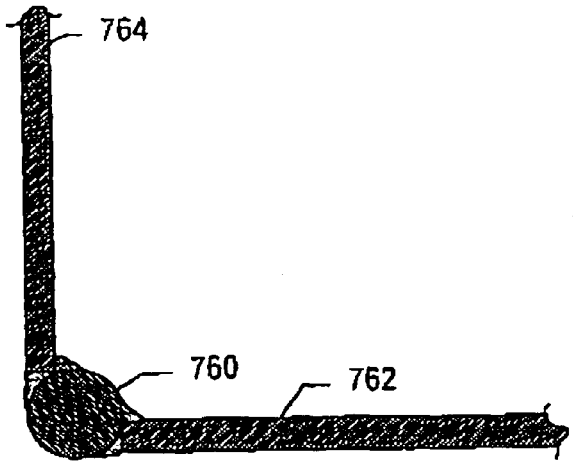
FIG. 16 is a cross sectional detail of the sharp bilge in the mid section.

FIG. 16 (located below FIG. 6) shows in cross section the detailed construction of the hard chine along the bilge of the vessel shown in FIGS. 7 to 9 (edge C in FIGS. 10 to 14). The bottom and side plates of the hull are shown at 760 and 762 respectively, each being a flat steel plate for example between 10 mm and 20 mm thickness, according to the desired strength. Although in principle these plates could be welded directly to one another along the bilge, it is easier to achieve a solid result using an intermediate piece such as the round bar 764 shown in the drawing. This bar may have diameter 50 mm, giving a radius of curvature of 25 mm (0.025 m) at the chine, which is negligible rounding on a vessel of 80–200 m length, 18–30 m beam. Rounder bars, pipes or pipe sections up to 200 mm (0.2 m) radius might be used. However, it is believed that the desired roll damping performance of the sharp bilge will be reduced at 0.2 m, and virtually eliminated at 0.5 m.

The ship has the following principal characteristics:

| | |
|---|---|
| Length on waterline | 140 m |
| Breadth of the upper deck (UD) | 23 m |
| Breadth at the waterline (WL) | 21 m |
| "Moulded Depth" (Baseline to UD) | 11.5 m |

The vessel of FIGS. 7 to 16 is shown for the sake of illustration, with two general purpose cranes and a moonpool for subsea access. Provided with suitable topside equipment and internal arrangements, however, the novel hull form can be adapted for a variety of specialist roles, such as subsea construction, drive support, pipelay well intervention or cable lay ship. The high roll damping, as a side-effect, provides very calm water in the lee of the hull facilitating operations over the side, with or without the provision of moonpools. The flare at the stern adds a reserve of buoyancy in high head seas and reduces pitch, translating it to heave as waves pass. As the bow picks up a wave the stern, and thus the stern flare, become immersed providing a sufficient reserve of buoyancy to limit the sinkage of the stern. This limits the pitch and also keeps the stern dry. In wave lengths where the bow and mid section are in successive waves there is insufficient energy to induce significant pitch. Where the wave length is greater than the ship's length, of course, the ship will pitch like any other.

What is claimed is:

1. A hull for a sea-going vessel of displacement type having a flat bottomed mid-ship section of a constant cross-section which is substantially rectangular below the water line, and a converging bow portion extending from said mid-ship section, said bow portion having a curved transition between the bottom thereof and each hull side, said mid-ship section having a relatively sharp transition between bottom and sides along the bilges, the transition in said mid-ship section being of radius less than 0.2 m.

2. A hull as claimed in claim 1, wherein said curved transitions are of simple continuous curved form.

3. A hull as claimed in claim 1, wherein the bow shape includes a substantially vertical stem topped by a flared prow, with substantially simple curved and planar sheets leading back into the hull, avoiding compound curves for the major part of the bow section.

4. A hull as claimed in claim 2, wherein the bow shape includes a substantially vertical stem topped by a flared prow, with substantially simple curved and planar sheets leading back into the hull, avoiding compound curves for the major part of the bow section.

5. A hull as claimed in claim 3, wherein the stem of the vessel is increasingly fine with increasing depth below the water line.

6. A hull as claimed in claim 4, wherein the stem of the vessel is increasingly fine with increasing depth below the water line.

7. A hull as claimed in claim 3, wherein given a beam of 20 m, the stem has a radius of curvature at the water line exceeding 1 m about the vertical axis.

8. A hull as claimed in claim 4, wherein given a beam of 20 m, the stem has a radius of curvature at the water line exceeding 1 m about the vertical axis.

9. A hull as claimed in claim 3, wherein the vertical stem has a cylindrical portion which curves aftwards to join the bottom of the hull, forming a minor portion of compound curve.

10. A hull as claimed in claim 4, wherein the vertical stem has a cylindrical portion which curves aftwards to join the bottom of the hull, forming a minor portion of compound curve.

11. A hull as claimed in claim 1, in which the vessel includes a stern section and the stern shape includes at least one propulsion arch formed by an inclined, substantially part-cylindrical surface extending from the flat bottom aft and upward to join the transom.

12. A hull as claimed in claim 11, wherein two propulsion arches are present in a side-by-side configuration.

13. A hull according to claim 1, wherein the mid-ship section of rectangular cross sections extends for more than half the water line length of the vessel hull.

14. A hull as claimed in claim 3, wherein the hull includes a complex compound curved portion transition between the stem portion and said curved bow portion at the water line transition between the bottom of the bow portion and the hull side.

15. A hull as claimed in claim 4, wherein the hull includes a complex compound curved portion transition between the stem portion and said curved bow portion at the water line transition between the bottom of the bow portion and the hull side.

16. A hull as claimed in claim 11, wherein the hull has a flat transom.

17. A hull as claimed in claim 12, wherein the hull has a flat transom.

18. A hull as claimed in claim 16, wherein inclined intermediate flat portions are provided between each arch and the transom to reduce drag.

19. A hull as claimed in claim 18, wherein a transition zone of compound curve shape is provided between the arch portions and the flat bottom portion, to reduce separation in the water flow and consequent drag.

20. A sea-going vessel having a hull as claimed in claim 1, wherein the vessel has a flat bottomed mid-ship section and a stern section provided with at least one propulsion arch formed such that water flowing to occupy the propulsion arch comes predominantly from beneath the bottom, rather than from the sides of the vessel as the vessel moves through the water.

21. A sea-going vessel as claimed in claim 20, the hull of the vessel below the water line comprising a parallel mid-ship section and bow and stern sections, the stern section comprising less than thirty percent compound curves in surface area.

22. A sea-going vessel as claimed in claim 20, the hull of the vessel below the water line comprising a parallel mid-ship section and bow and stern sections, the stern section comprising less than twenty percent compound curves in surface area.

23. A sea-going vessel as claimed in claim 20, the hull of the vessel below the water line comprising a parallel mid-ship section and bow and stern sections, the stern section comprising less than ten percent compound curves in surface area.

24. A sea-going vessel having a hull as claimed in claim 1, the hull of the vessel below the water line comprising less than five percent compound curves in surface area.

25. A sea-going vessel having a hull as claimed in claim 1, wherein the bow section comprises less than ten percent compound curves in surface area.

26. A sea-going vessel having a hull as claimed in claim 1, wherein the bow section comprises less than twenty percent compound curves in surface area.

27. A sea-going vessel having a hull as claimed in claim 1, wherein the bow section comprises less than thirty percent compound curves in surface area.

28. A hull or vessel as claimed in claim 1, wherein the hull includes above the water line in the mid-ship section an outward flaring extending longitudinally over a substantial part of each side of the hull.

* * * * *